US007367555B2

(12) United States Patent
Yoshihisa et al.

(10) Patent No.: US 7,367,555 B2
(45) Date of Patent: May 6, 2008

(54) RECORDING MEDIUM TRANSFER APPARATUS

(75) Inventors: Yasuhiko Yoshihisa, Nagano-ken (JP); Kosaku Nobuta, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 106 days.

(21) Appl. No.: 10/831,361

(22) Filed: Apr. 26, 2004

(65) Prior Publication Data

US 2005/0001892 A1 Jan. 6, 2005

(30) Foreign Application Priority Data

Apr. 28, 2003 (JP) ..... 2003-123776

(51) Int. Cl.
*B65H 7/08* (2006.01)

(52) U.S. Cl. ..... 271/110; 271/270; 271/10.02; 271/10.03; 271/3.15; 271/3.17; 271/4.02; 271/4.03

(58) Field of Classification Search ..... 271/10.02, 271/10.03, 10.11, 10.09, 110, 3.15, 3.17, 271/4.02, 4.03, 4.08, 4.1, 270; 347/104
See application file for complete search history.

(56) References Cited

U.S. PATENT DOCUMENTS 6,421,581 B1 * 7/2002 Hamamoto et al. ..... 700/223
6,485,011 B1 * 11/2002 Yen et al. ..... 271/10.03
6,791,725 B1 * 9/2004 Ohtani ..... 358/498

FOREIGN PATENT DOCUMENTS

| | | | |
|---|---|---|---|
| JP | 4-144844 | A | 5/1992 |
| JP | 4-298368 | A | 10/1992 |
| JP | 2000-16635 | A | 1/2000 |
| JP | 2002-283649 | A | 10/2002 |

* cited by examiner

*Primary Examiner*—Patrick Mackey
*Assistant Examiner*—Thomas Morrison
(74) *Attorney, Agent, or Firm*—Sughrue Mion, PLLC

(57) ABSTRACT

A recording medium transfer apparatus includes a motor control unit for controlling the motor to rotate at higher speed when the recording medium is fed to the liquid ejection area than that when the recording medium is discharged out of the liquid ejection area, and a feed control unit for controlling a next recording medium to be fed simultaneously with discharge of the recording medium, if a position of a rear end of the recording medium when recording or printing has been finished is situated upstream of a predetermined position, which is upstream of the discharge roller as much as a distance between a feed start position of the recording medium and the liquid ejection area, whereas controlling the next recording medium to start to be fed after discharge of the recording medium has been finished, if the position of the rear end of the recording medium when recording or printing has been finished is situated downstream of the predetermined position.

4 Claims, 13 Drawing Sheets

RECORDING MEDIUM TRANSFER APPARATUS

This patent application claims priority from a Japanese patent application No. 2003-123776 filed on Apr. 28, 2003, the contents of which are incorporated herein by reference.

BACKGROUND OF THE INVENTION

1. Field of the Invention

The present invention relates to a recording medium transfer apparatus. More particularly, the present invention relates to a recording medium transfer apparatus for transferring a recording medium on which recording or printing is performed by ejecting liquid to a liquid ejection area where the liquid is ejected onto the recording medium.

2. Description of the Related Art

A liquid ejecting apparatus such as an inkjet type recording apparatus includes a recording medium transfer apparatus. In order to improve the recording throughput of the liquid ejecting apparatus, it is effective to increase the speed of transferring the recording medium by the recording medium transfer apparatus. However,the transfer speed of the recording medium is restricted depending on the operation state of the liquid ejecting apparatus.

When many recording mediums are discharged, it is necessary to obtain the stackability by which the discharged recording mediums are stacked at approximately the same position on a discharge stacker. In order to obtain the stackability, the discharge speed at which the discharge roller discharges the recording mediums to the discharge stacker is necessarily restricted to a specific value or less, e.g. 10[ips] (inch per second). If the discharge speed of the recording medium exceeds the specific value, the electrostatic force caused by electrification of the recording medium mainly decreases the stackability. Meanwhile, when the recording medium is fed to the liquid ejection area where liquid is ejected onto the recording medium, in order to increase the throughput, it is preferable that the feed roller should transfer the recording medium at higher speed, e.g. 14[ips], than the discharge roller during discharge.

For the purpose of cost-down, a technology in which the liquid ejecting apparatus drives both the discharge roller for discharging the recording medium on which recording has been finished and the feed roller for feeding the next recording medium by one motor has been recently developed as disclosed, for example, in Japanese Patent Application Publication No. 2002-283649.

If the discharge and feed rollers are driven by one motor, both the rollers rotate at the same speed. In this case, when the rotation speed of the feed roller becomes high to improve the throughput, the rotation speed of the discharge roller also becomes high, so there is such a problem that the stackability cannot be obtained.

SUMMARY OF THE INVENTION

Therefore, it is an object of the present invention to provide a recording medium transfer apparatus, which is capable of overcoming the above drawbacks accompanying the conventional art. The above and other objects can be achieved by combinations described in the independent claims. The dependent claims define further advantageous and exemplary combinations of the present invention.

According to the first aspect of the present invention, a recording medium transfer apparatus for feeding a recording medium, on which recording or printing is performed by ejecting liquid, to a liquid ejection area in which the liquid is ejected onto the recording medium includes a feed roller for feeding the recording medium towards the liquid ejection area, a discharge roller for discharging the recording medium, on which recording or printing has been performed, out of the liquid ejection area, a motor for driving the feed and discharge rollers, a motor control unit for controlling the motor to rotate at higher speed when the recording medium is fed to the liquid ejection area than that when the recording medium is discharged out of the liquid ejection area, and a feed control unit for controlling a next recording medium to be fed simultaneously with discharge of the recording medium, if a position of a rear end of the recording medium when recording or printing has been finished is situated upstream of a predetermined position, which is upstream of the discharge roller as much as a distance between a feed start position of the recording medium and the liquid ejection area, whereas controlling the next recording medium to start to be fed after discharge of the recording medium has been finished, if the position of the rear end of the recording medium when recording or printing has been finished is situated downstream of the predetermined position.

Accordingly, in the recording medium transfer apparatus, while the recording medium which will be recorded next is being fed to the liquid ejection area, the recording medium on which recording has been finished is prevented from being discharged out of the discharge roller at high speed. Therefore, the rear end of the recording medium is discharged at lower speed than the feed speed. Thus, the recording medium transfer apparatus can obtain the stackability the discharged recording medium as well as improving the transfer throughput.

The recording medium transfer apparatus may further include a recording medium sensor disposed at the predetermined position for detecting the recording medium, wherein the feed control unit controls the next recording medium to be fed simultaneously with discharge of the recording medium, if the recording medium sensor detects the recording medium when recording or printing has been finished, whereas controlling the next recording medium to be fed after discharge of the recording medium has been finished, if the recording medium sensor does not detect the recording medium when recording or printing has been finished. Accordingly, it is possible to easily judge whether the next recording medium should start to be fed or not based on the detection result by the recording medium sensor.

The recording medium transfer apparatus may further include a roller lock mechanism driven by the motor for preventing the feedroller from being rotated by the motor or stopping rotation prevention of the feed roller by reverse rotation of the motor, wherein when the motor rotates forward, the feed and discharge rollers are rotated in such direction that the recording medium is transferred forward, and the feed control unit uses, as the predetermined position, a position situated further downstream of the feed start position of the next recording medium than a sum of a reverse transfer amount by which the recording medium is transferred reversely due to the reverse rotation of the motor while the rotation prevention is being stopped and width of the liquid ejection area in a transfer direction of the recording medium. Accordingly, the rear end of the recording medium on which recording has been finished and the front end of the recording medium which will be recorded next are not overlapped during transfer, and when recording starts to be performed on the next recording medium, it is prevented that liquid is unnecessarily ejected onto the rear end of the recording medium on which recording has been finished.

According to the second aspect of the present invention, a recording medium transfer apparatus for feeding a recording medium, on which recording or printing is performed, to a liquid ejection area in which a liquid ejecting head ejects the liquid onto the recording medium to perform recording or printing includes a feed roller for feeding the recording medium to the liquid ejection area, a discharge roller for discharging the recording medium, on which recording or printing has been performed, out of the liquid ejection area, a motor for driving the feed and discharge rollers to be rotated in such direction that the recording medium is transferred forward when the motor rotates forward, a roller lock mechanism driven by the motor for preventing the feed roller from being rotated by the motor or stopping rotation prevention of the feed roller by reverse rotation of the motor, and a feed control unit for controlling a next recording medium, which will be fed next, to be fed simultaneously with discharge of the recording medium, if a distance between a rear end of the recording medium when recording or printing has been finished and a feed start position of the next recording medium is larger than a sum of a reverse transfer amount by which the recording medium is transferred reversely due to the reverse rotation of the motor while the rotation prevention is being stopped and width of the liquid ejection area in a transfer direction of the recording medium.

Accordingly, since it is prevented that the rear end of the recording medium on which recording has been finished and the front end of the recording medium which will be recorded next are overlapped during transfer, and that when recording starts to be performed on the next recording medium, liquid is unnecessarily ejected onto the rear end of the recording medium on which recording has been finished, the transfer throughput can be improved.

The recording medium transfer apparatus may further include a recording medium sensor disposed further downstream of the feed start position of the next recording medium than a sum of the reverse transfer amount and the width of the liquid ejection area in the transfer direction of the recording medium for detecting the recording medium, wherein the feed control unit controls the next recording medium to be fed simultaneously with discharge of the recording medium, if the recording medium sensor does not detect the recording medium when recording or printing has been finished, where as controlling the next recording medium to start to be fed after discharge of the recording medium has been finished, if the recording medium sensor detects the recording medium when recording or printing has been finished. Accordingly, it is possible to easily judge whether the next recording medium should start to be fed or not based on the detection result by the recording medium sensor.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
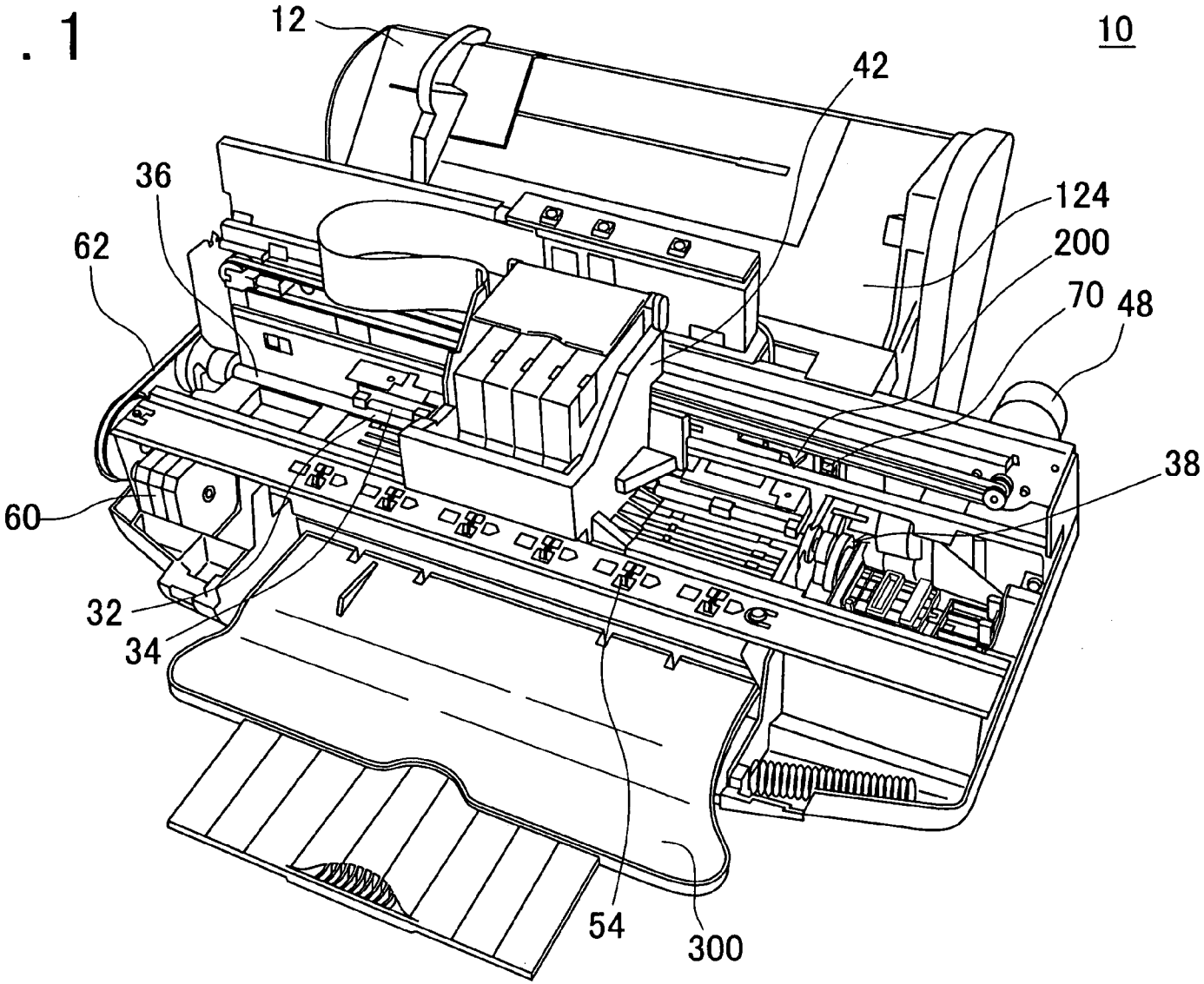
FIG. 1 shows a perspective view of an inkjet type recording apparatus 10.

FIG. 1 shows a perspective view of an inkjet type recording apparatus 10 which is an example of a liquid ejecting apparatus. The inkjet type recording apparatus 10 of this embodiment includes a recording medium transfer apparatus therein. The recording medium transfer apparatus includes a feed roller for feeding recording mediums towards a liquid ejection area, a discharge roller for discharging the recording mediums on which recording or printing has been finished out of the liquid ejection area, and a step motor 60 for driving the feed and discharge rollers. When the recording medium transfer apparatus feeds the recording medium to the liquid ejection area, it allows the step motor 60 to rotate at higher speed than that when discharging the recording mediums out of the liquid ejection area. And if the position of a rear end of the recording medium when recording or printing has been finished is situated upstream of a predetermined position, which is upstream of the discharge roller as much as the distance between a feed start position of the recording medium and the liquid ejection area, the next recording medium is fed at high speed simultaneously with the discharge of the recording medium. Meanwhile, if the position of the rear end of the recording medium when recording or printing has been finished is situated downstream of the predetermined position, which is upstream of the discharge roller as much as the distance between the feed start position of the recording medium and the liquid ejection area, the next recording medium is fed at high speed after the discharge of the recording medium is finished at low speed.

Accordingly, while the recording medium transfer apparatus is feeding the recording medium which will be recorded next towards the liquid ejection area, it prevents the recording medium on which recording has been finished from being discharged out of the discharge roller at high speed. Therefore, the rear end of the recording medium is discharged at lower speed than the feed speed. Owing to this, the recording medium transfer apparatus can obtain the stackability of the discharged recording mediums as well as improving the transfer throughput.

Further, the inkjet type recording apparatus 10 is an example of a liquid ejecting apparatus for performing recording or printing by ejecting liquid onto the recording mediums. And the recording head of the inkjet type recording apparatus 10 is an example of a liquid ejecting head of the liquid ejecting apparatus. Nozzles provided on the recording head are an example of the ejection holes of the liquid ejecting head.

However, the present invention is not limited to this. As another example of the liquid ejecting apparatus, there is a color filter manufacturing apparatus for manufacturing a color filter of a liquid crystal display. In this case, a color material ejecting head of the color filter manufacturing apparatus is an example of the liquid ejecting head. Further another example of the liquid ejecting apparatus is an electrode forming apparatus for forming electrodes such as an organic EL display, a FED (Field Emission display)or the like. In this case, an electrode material (conduction paste) ejecting head of the electrode forming apparatus is an example of the liquid ejecting head. Further another example is a biochip manufacturing apparatus for manufacturing biochips. In this case, a bio organism ejecting head of the biochip manufacturing apparatus and a sample ejecting head as a minute pipette are examples of the liquid ejecting head. The liquid ejecting apparatus of the present invention includes other liquid ejecting apparatuses used for industrial purposes. In addition, the recording medium is a material on which recording or printing is performed by ejection of liquid, which includes a recording paper, a circuit board on which circuit patterns such as display electrodes are formed, a CD-ROM for label recording, a preparation on which a DNA circuit is recorded, etc.

Figure 2:
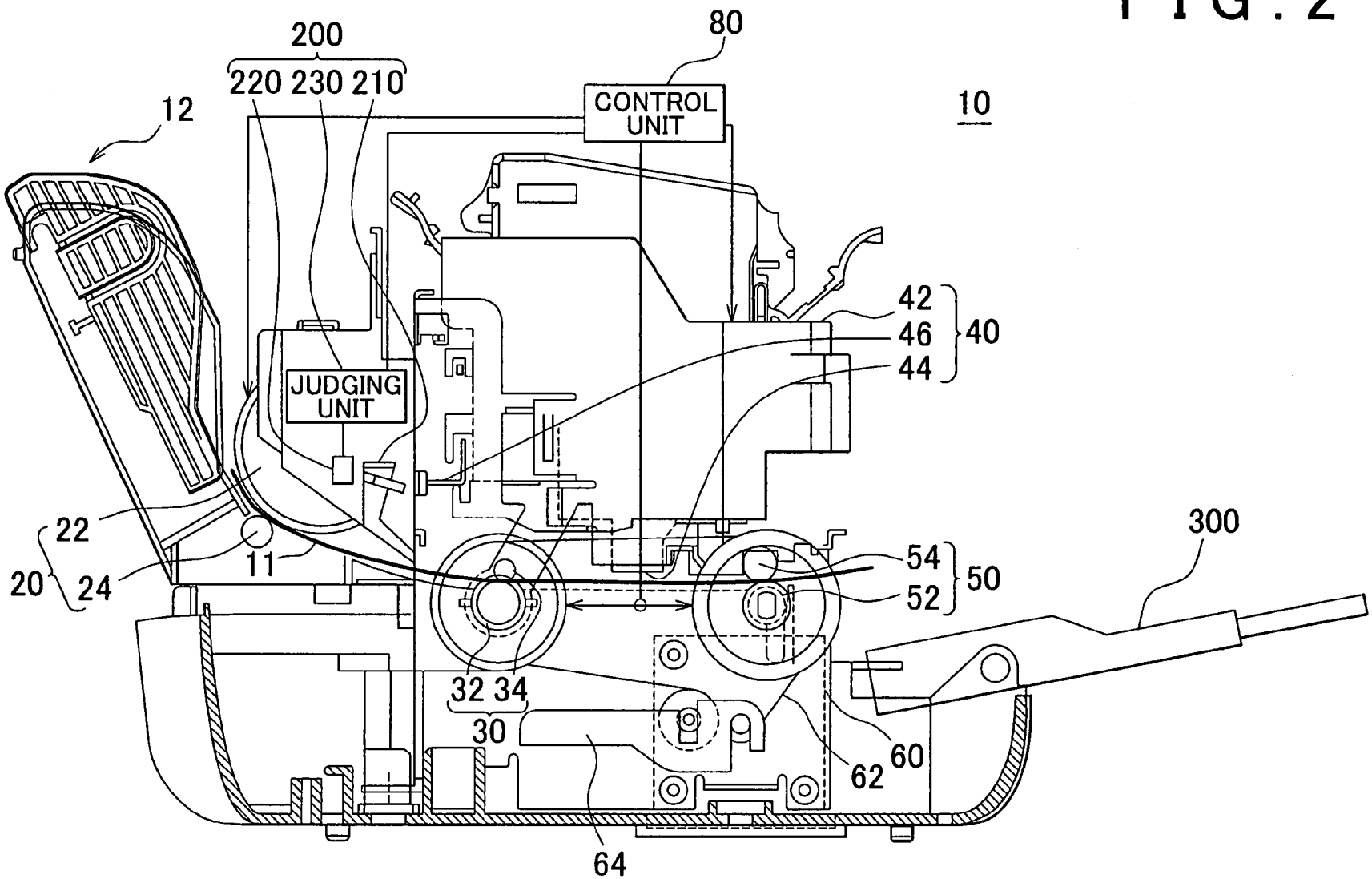
FIG. 2 is a side view of the inkjet type recording apparatus 10.

Next, another configuration of the inkjet type recording apparatus 10 is shown in FIGS. 1 and 2. FIG. 2 is a side view of the inkjet type recording apparatus 10. FIG. 2 shows the inkjet type recording apparatus 10 together with the recording medium 11 during recording.

The inkjet type recording apparatus 10, as shown in FIGS. 1 and 2, includes a recording medium tray 12 for holding a plurality of recording mediums 11, a feed unit 20 for feeding the recording mediums 11 being pushed out of the recording medium tray 12 towards the liquid ejection area, a transfer unit 30 for transferring the recording mediums 11 being fed by the feed unit 20 to the liquid ejection area, a recording unit 40 for performing recording onto the recording mediums 11 within the liquid ejection area, a discharge unit 50 for discharging the recording mediums out of the liquid ejection area, a discharge stacker 300 for stacking the recording mediums 11 discharged out of the discharge unit 50, a step motor 60, a lock lever 70 for locking a carriage, a control unit 80 for controlling the entire inkjet type recording apparatus 10, and a detecting unit 200. The recording medium tray 12 includes a hopper 124 for pushing out the recording mediums 11 stacked on the recording medium tray 12. The control unit 80 is an example a motor control unit and a feed control unit of this invention. In addition, the step motor 60 is an example of a motor of this invention.

The feed unit 20 includes a feed roller 22 and a retarder roller 24 which is rotated accompanying the feed roller 22. The feed roller 22 and the retarder roller 24 hold one on top of the stack of the recording mediums 11 therebetween, which is being pushed out of the recording medium tray 12 by the hopper 124, and feed it one by one towards the liquid ejection area via the transfer unit 30.

The transfer unit 30 includes a transfer roller 32 driven by the step motor 60 and a driven transfer roller 34 which is rotated accompanying the transfer roller 32, and a drive shaft 36 of the transfer roller 32. The transfer roller 32 rotates interposing the recording mediums 11 being fed by the feed roller 20 between itself and the driven transfer roller 34, and transfers it to the liquid ejection area.

The recording unit 40 includes a carriage 42 shown in FIG. 1, a recording head 44, and a motor 48 for moving the carriage 42. Further, it includes a guide plate 46 for supporting the carriage 42 to be slidable in a main scanning direction which is approximately perpendicular to the transfer direction of the recording medium 11.

The discharge unit 50 includes a discharge roller 52 driven by the step motor 60 and a driven discharge roller 54 which is rotated accompanying the discharge roller 52. The discharge roller 52 and the driven discharge roller 54 rotate holding the recording medium 11 after recording therebetween, and discharge it out of the liquid ejection area. The discharge stacker 300 stacks a plurality of recording mediums 11 discharged by the discharge unit 50.

Further, power is transmitted from the step motor 60 to the transfer roller 32 and the discharge roller 52 via a belt 62. The belt 62 is applied with tension by a tensioner 64. The step motor 60, the tensioner 64, the transfer roller 32, and the discharge roller 52 are sequentially arranged along the flowing direction of the belt. Meanwhile, to the feed roller 22 power is transmitted from the step motor 60 via a gear and clutch mechanism. When the step motor 60 rotates forward, it makes the feed roller 22, the transfer roller 32, and the discharge roller 52 rotated in a forward transfer direction of the recording medium 11.

The lock lever 70 projects into the orbit of the carriage 42 when the inkjet type recording apparatus 10 is not in operation so as not to allow the carriage 42 to move towards the liquid ejection area. The lock lever 70 is turned by the step motor 60 via the drive shaft 36 of the transfer roller 32 and a gear mechanism 38 provided at an end of the drive shaft 36. When the step motor 60 rotates in a reverse transfer direction of the recording medium 11, the lock lever 70 is turned in the direction to lock the carriage 42, whereas when the step motor 60 rotates in the forward transfer direction of the recording medium 11, the lock lever 70 is turned in the direction to unlock the carriage 42. Further, the lock lever 70 locks a clutch mechanism for transmitting the power of the step motor 60 to the feed roller 22 so as to prevent the rotation of the feed roller 22.

The detecting unit 200 includes a contact lever 210 which is turned by being pushed downwards by the carriage 42 or turned in the same direction by contacting the recording medium 11, a sensor 220 for detecting the turning of the contact lever 210, and a judging unit 230 for recognizing the carriage 42 or the recording medium 11 based on the detection result of the sensor 220.

Here, one end of the contact lever 210 projects into the orbit of the carriage 42, so that it is pushed downwards by the carriage 42. In addition, the contact lever 210 is positioned between the feed unit 20 and the transfer unit 30 in the transfer direction of the recording medium 11. And the contact lever 210 is positioned between the liquid ejection area and the standby position of the carriage 42 in the main scanning direction of the carriage 42.

The contact lever 210 is pushed downwards by the carriage 42 and pushed out of the movement path of the carriage 42, and thus the sensor 220 detects the movement, so the detecting unit 200 detects the carriage 42. And when the recording medium is transferred towards the liquid ejection area, the contact lever 210 is turned in such a direction that it is pushed out of the movement path of the carriage 42 by the recording medium. Accordingly, the detecting unit 200 can detect the recording medium.

In the above configuration, the control unit 80 controls the nozzles of the recording head 44 to eject liquid while reciprocating the carriage 42 along the guide plate 46. And since the control unit 80 controls the recording medium 11 to be transferred whenever the carriage 42 performs one scanning, recording is performed on the entire recording medium 11. Further, the inkjet type recording apparatus 10 may perform recording in both the forward and backward paths of the recording head 44 or in either the forward or backward path.

Figure 3:
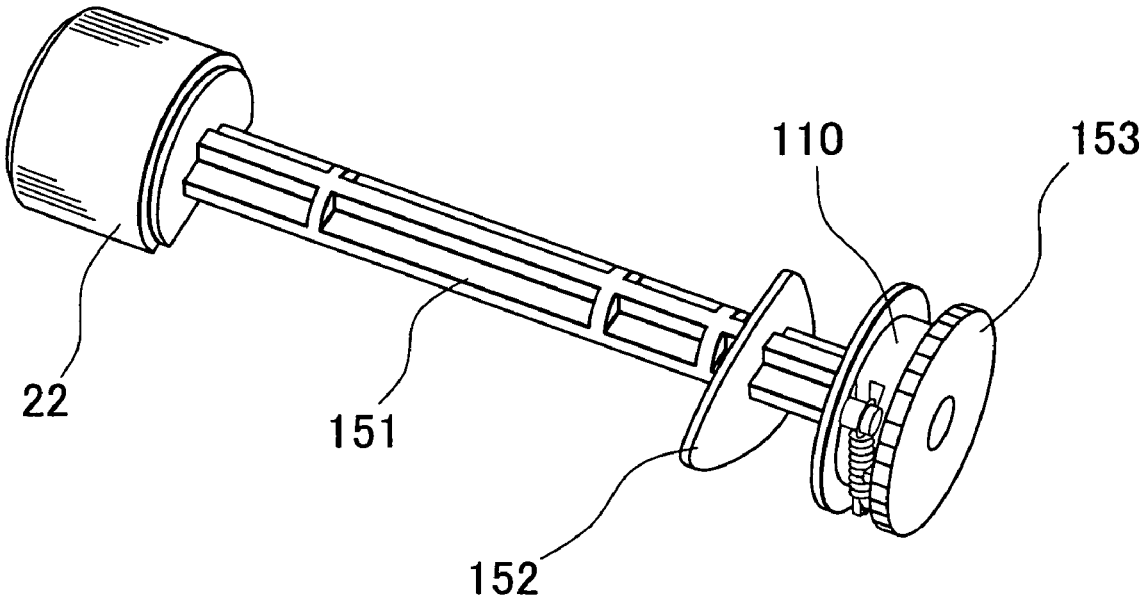
FIG. 3 shows a perspective view of the configuration of a part of a roller lock mechanism 400.

Next, a roller lock mechanism for transmitting the power of the step motor 60 to the feed roller 22 will be described. FIG. 3 shows a perspective view of the configuration of a part of the roller lock mechanism 400. The roller lock mechanism 400 includes a feed gear 153 which is coupled to the step motor 60 via the gear mechanism, and a clutch 110 switches whether to transmit the driving force transmitted to the feed gear 153 to the feed roller shaft 151. One end of the feed roller shaft 151 is integrally formed with the feed roller 22, while the other end of the feed roller shaft 151 is engaged with the clutch 110 and the feed gear 153 in this order. Further, a cam 152 for moving the hopper up and down is integrally formed with the feed roller shaft 151 near the clutch 110 between the feed roller 22 and the clutch 110. The cam 152 for moving the hopper up and down transmits the rotation force of the feed roller shaft 151 to the hopper 124 as the power to push out the recording medium 11 stacked on the recording medium tray 12.

Figure 4:
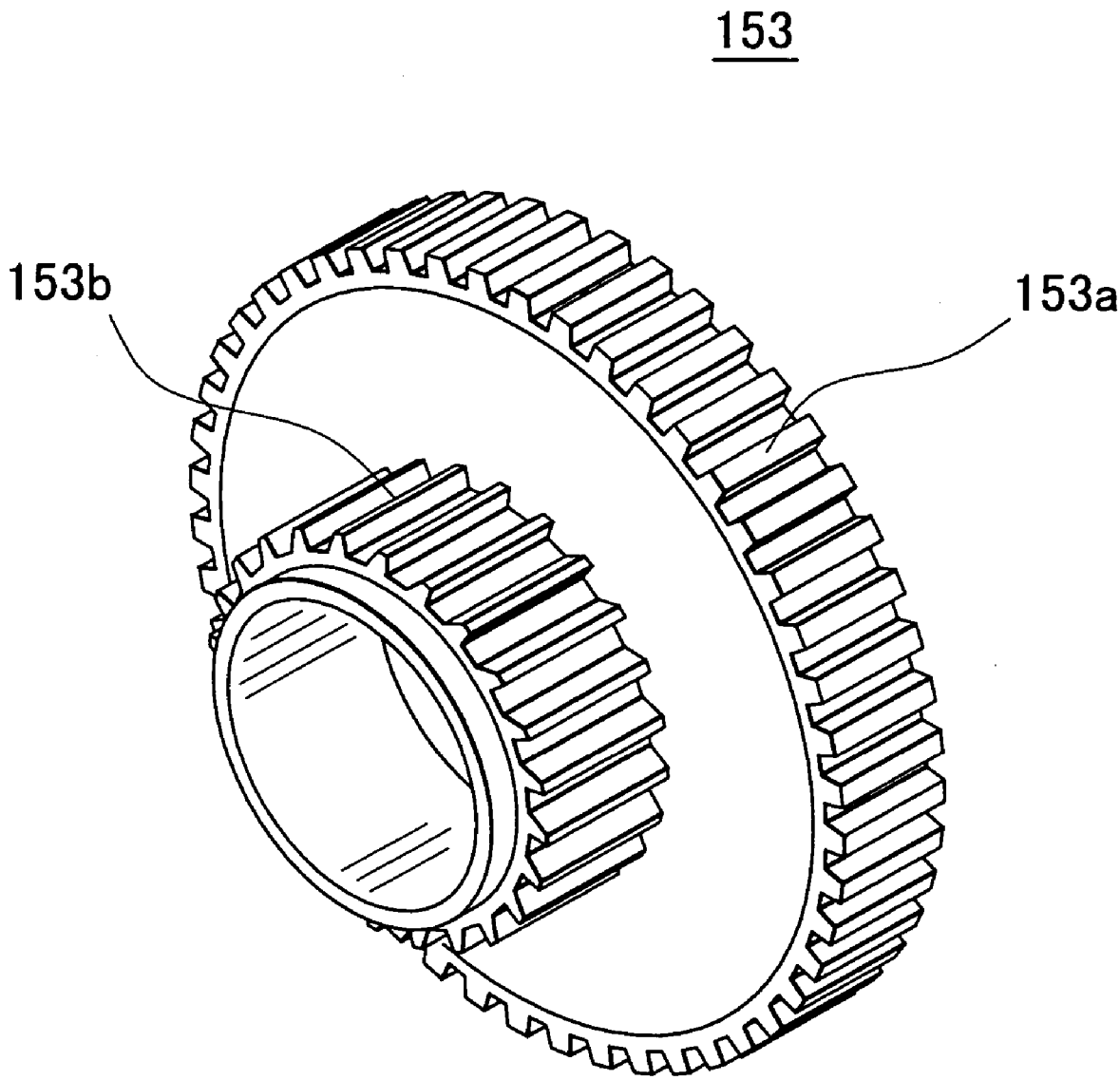
FIG. 4 shows a perspective view of a feed gear 153 in detail.

FIG. 4 shows a perspective view of the feed gear 153 in detail. The feed gear 153 includes a flange-shaped gear 153*a* and a boss-shaped gear 153*b* integrally formed with the gear 153*a*. The gear 153*a* is coupled to the step motor 60 via the gear mechanism, and rotated accompanying the step motor 60. The clutch 110 shown in FIG. 3 switches whether to be coupled to the gear 153*b*, so that it switches whether to transmit the driving force of the feed gear 153 to the feed roller shaft 151. In other words, the clutch 110 transmits the power of the step motor 60 to the feed roller 22 via the feed roller shaft 151 when coupled to the gear 153*b*, whereas disconnecting the power of the step motor 60 to the feed roller 22 when not coupled to the gear 153*b*.

Figure 5:
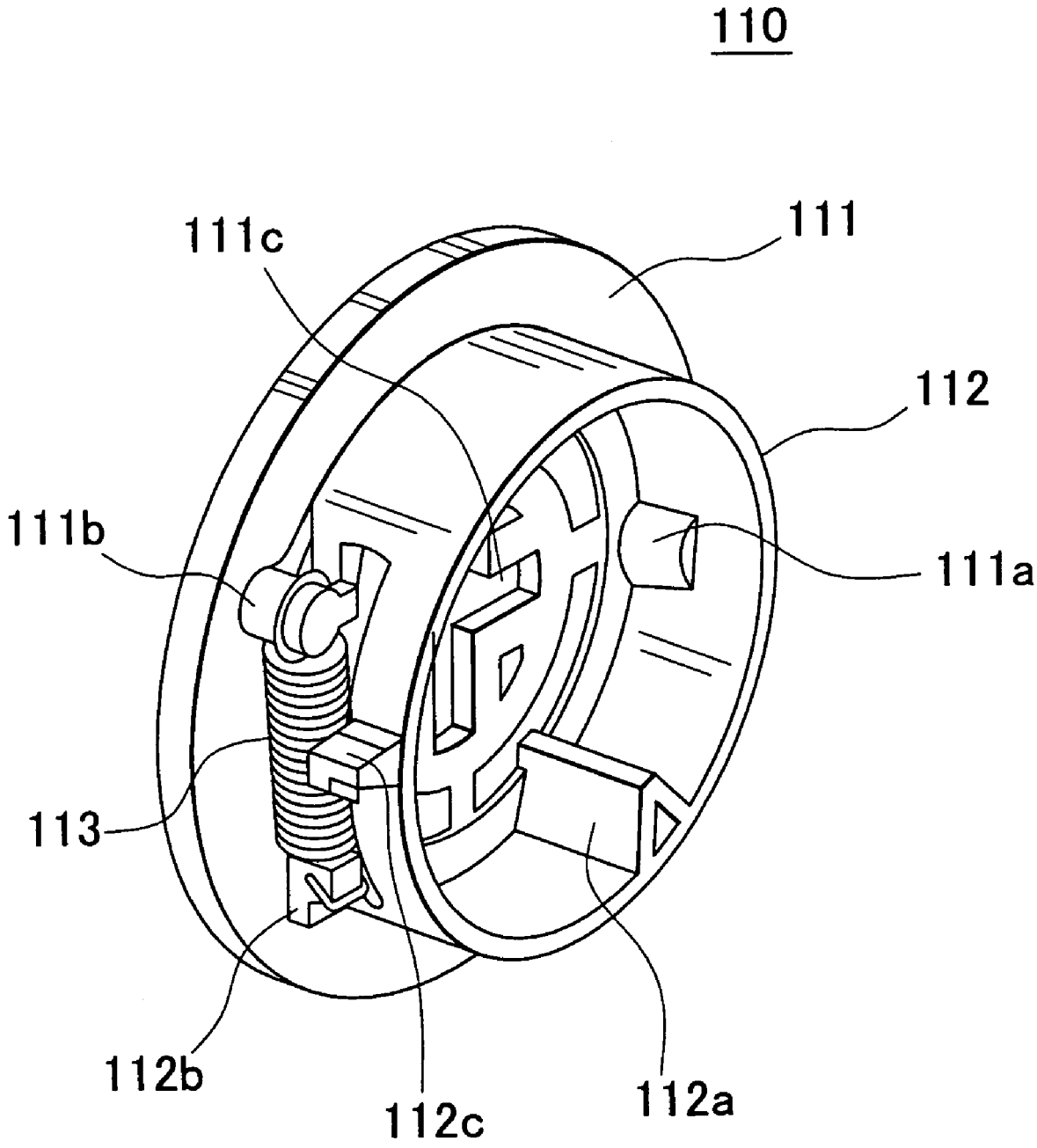
FIG. 5 shows a perspective view of a clutch 110 in detail.

FIG. 5 shows a perspective view of the clutch 110 in detail. The clutch 110 includes a disc 111, a ring 112, and a clutch spring 113. The disc 111 includes a ring support shaft 111*a* for rotatably supporting the ring 112 on its surface and a spring hanger 111*b* for fixing one end of the clutch spring 113, and has a cross-shaped opening 111*c* which is to be engaged with a cross-shaped end of the feed roller shaft 151 in the middle thereof. The clutch spring 113 is disposed opposite the ring support shaft 111*a* with regard to the circumferential section of the ring 112. The ring 112 includes a projection 112*a* for geared engagement with the gear 153*b* of the feed gear 153 on its inner circumferential section, a spring hanger 112*b* for fixing the other end of the clutch spring 113 on its outer circumferential section, and an engagement section 112*c* for engagement with the locklever 70. The engagement section 112*c* is disposed opposite the ring support shaft 111*a* with regard to the circumferential section of the ring 112. The ring 112 is rotatable in the longitudinal extension direction of the clutch spring 113 with the ring support shaft 111*a* being considered as a pivot.

Figure 6:
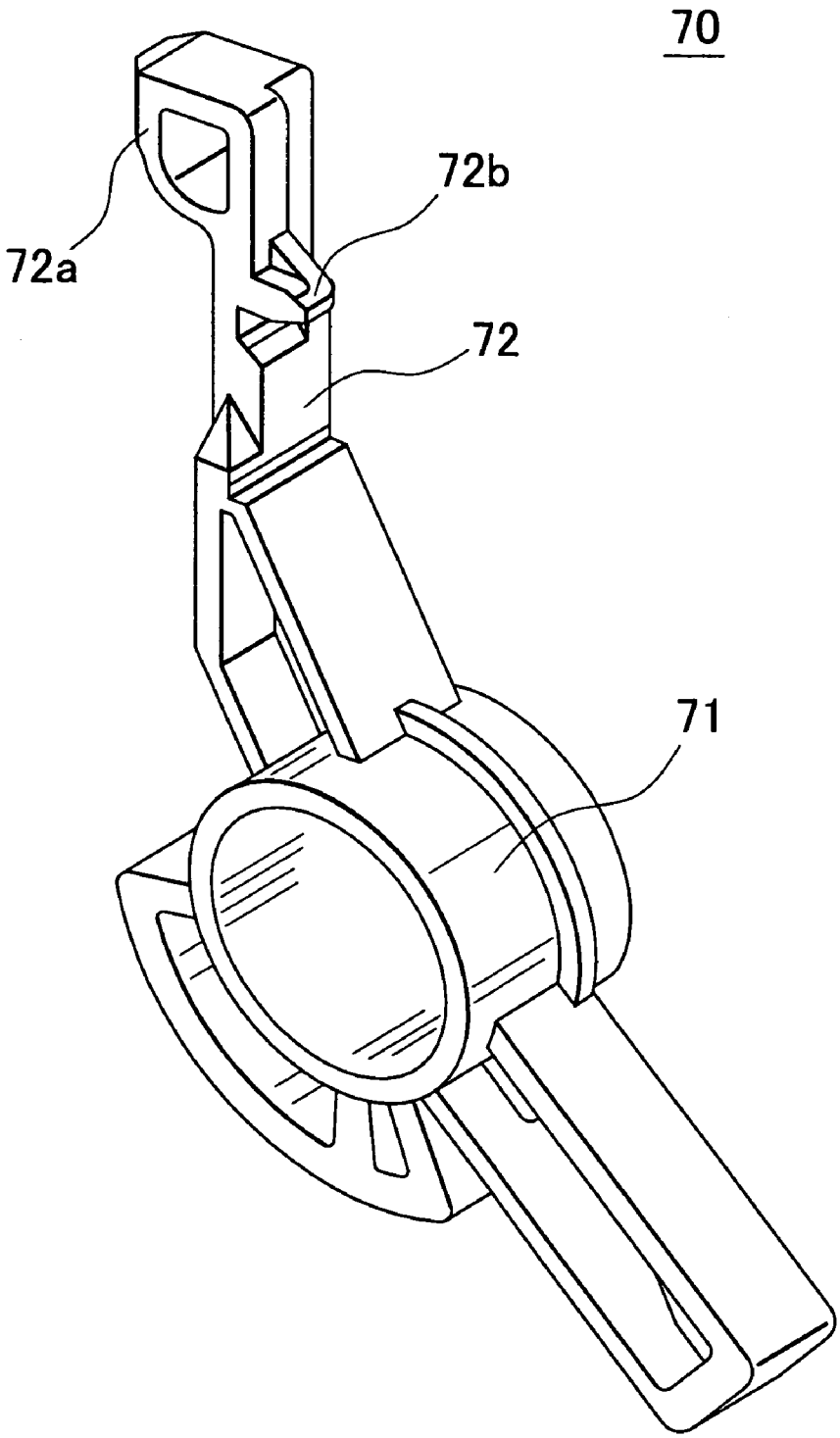
FIG. 6 shows a perspective view of a lock lever 70 in detail.

FIG. 6 shows a perspective view of the lock lever 70 in detail. The lock lever 70 includes a rotation section 71 and an arm section 72 extending from the rotation section 71. The arm section 72 includes a holding claw 72*a* for locking the carriage 42 and an engagement claw 72*b* for engagement with the engagement section 112*c* of the ring 112 on its end section.

Figure 7:
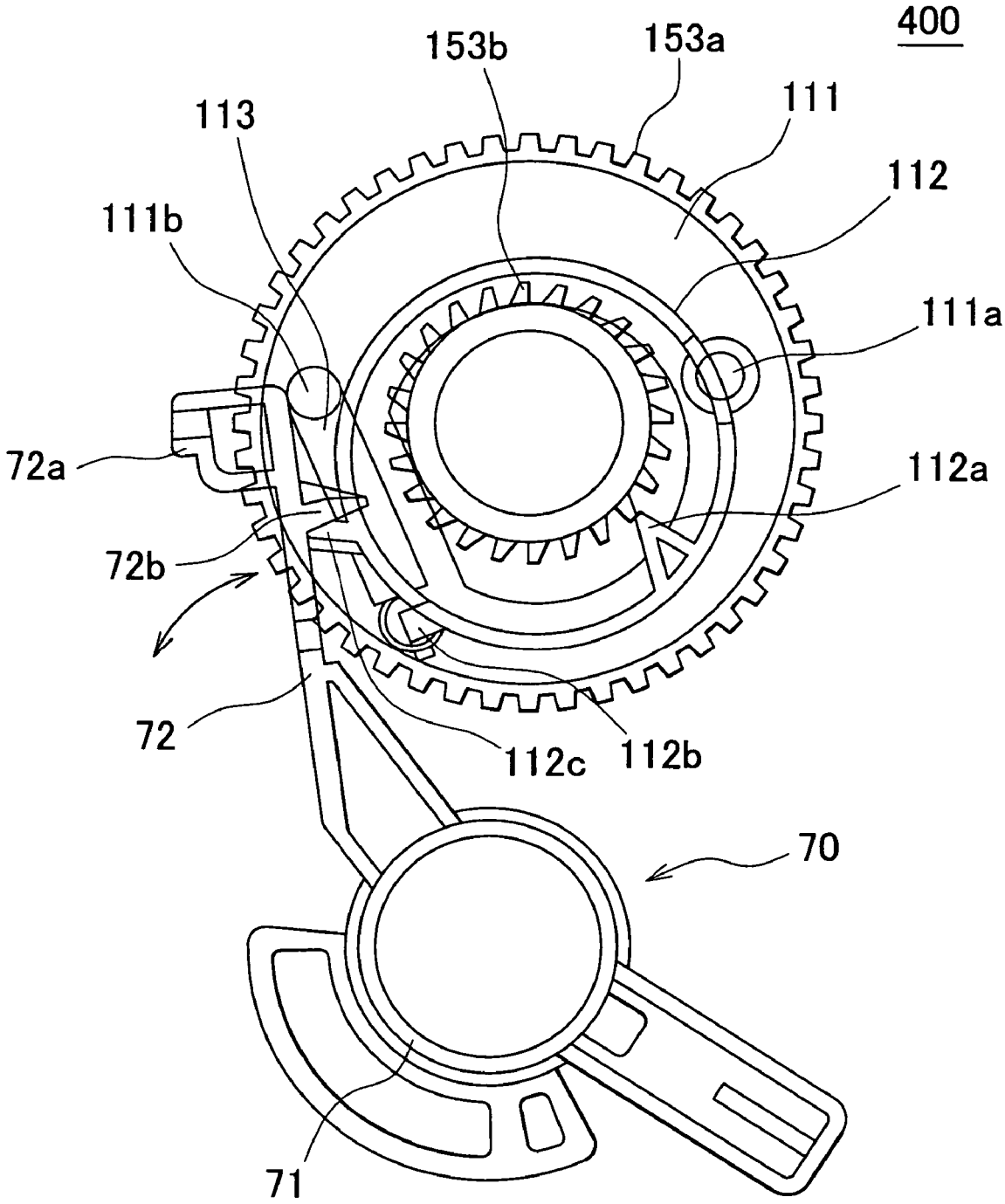
FIG. 7 shows a perspective view of the roller lock mechanism 400.

FIG. 7 shows a perspective view of the roller lock mechanism 400 while preventing the rotation of the feed roller 22. The rotation section 71 of the lock lever 70 is coupled to the step motor 60 via the drive shaft 36 of the transfer roller 32 and the gear mechanism 38 provided at the drive shaft 36, and driven in the direction where the engagement claw 72*b* is engaged with the engagement section 112*c* of the ring 112 by the forward rotation of the step motor 60. While the engagement claw 72*b* of the lock lever 70 is being engaged with the engagement section 112*c* of the ring 112, the ring 112 is standing by with the ring support shaft 111*a* functioning as a pivot, and the projection 112*a* of the ring 112 being separated from the gear 153*b*. In this case, the rotation of the feed gear 153 is not transferred to the disc 111 via the ring 112. Accordingly, the roller lock mechanism 400 prevents the rotation of the feed roller 22.

Meanwhile, when the step motor 60 rotates reversely, the feed gear 153 and the lock lever 70 are rotated reversely, i.e. counterclockwise in the drawing. Accordingly, the engagement claw 72*b* is separated from the engagement section 112*c*. When the engagement claw 72*b* is separated from the engagement section 112*c*, the ring 112 of the clutch 110 is rotated clockwise by the spring force of the clutch spring 113 with the ring support shaft 111*a* functioning as a pivot, whereby the projection 112*a* is geared with the gear 153*b*. Accordingly, the rotation force of the feed gear 153 rotating reversely is transmitted to the ring 112.

Here, the shape of the projection 112*a* of the gear 153*b* is designed to disperse the reverse rotation of the feed gear 153 in the circumferential direction of the feed gear 153 and the direction away from the center of the feed gear 153. Accordingly, the ring 112 which is receiving the rotation force of the feed gear 153 rotating reversely allows the disc 111 to be rotated reversely while rotating counterclockwise against the disc 111 with the ring support shaft 111*a* functioning as a pivot. At this time, accompanying the reverse rotation of the disc 111 the feed roller shaft 151 and the feed roller 22 are also rotated in reverse direction. Accordingly, the recording medium 11 shown in FIG. 2 is transferred reversely accompanying the reverse rotation of the feed roller 22.

Since the ring 112 is turned counterclockwise against the disc 111 with the ring support shaft 111*a* functioning as a pivot, the projection 112*a* is not geared to the gear 153*b*, and the ring 112 idly rotates against the reverse rotation of the feed gear 153.

Next, when the step motor 60 rotates forward, the feed gear 153 and the lock lever 70 start to rotate forward, i.e. clockwise in the drawing. Here, since the projection 112*a* is geared to the gear 153*b* by the spring force of the clutch spring 113, the engagement section 112*c* starts to rotate forward. At this time, the engagement section 112*c* is positioned ahead the engagement claw 72*b* of the arm section 72 in the forward rotation direction as much as the idle rotation of the projection 112*a* during the reverse rotation of the gear 153*b*. Therefore, before the engagement claw 72*b* returns to the position to lock the engagement section 112*c* by the forward rotation of the lock lever 70, the engagement section 112*c* passes by the engagement position with the engagement claw 72*b*. As above, the roller lock mechanism 400 stops preventing the rotation of the feed roller 22.

After the engagement section 112*c* passes by the engagement position with the engagement claw 72*b*, in approximately one rotation, the lock lever 70 returns to the position to lock the engagement section 112*c* of the clutch 110 by the power of the step motor 60. Then the engagement section 112*c* of the clutch 110 which has performed one rotation is engaged with the engagement claw 72*b* of the lock lever 70 again. In other words, when the feed roller 22 performs approximately one rotation in the forward rotation direction after stopping the prevention of the rotation by the roller lock mechanism 400, the rotation is prevented again. While the feed roller 22 performs one rotation in the forward rotation direction, the recording medium 11 is fed towards the liquid ejection area.

In the inkjet type recording apparatus 10 described above, an example of control to improve the transfer throughput, will be hereinafter described. In this embodiment, the control unit 80 improves the transfer throughput by controlling the rotation direction and rotation speed of the step motor 60 and the movement of the lock lever 70 in response to the position of the rear end of the recording medium 11 when recording has been finished.

Figure 8:
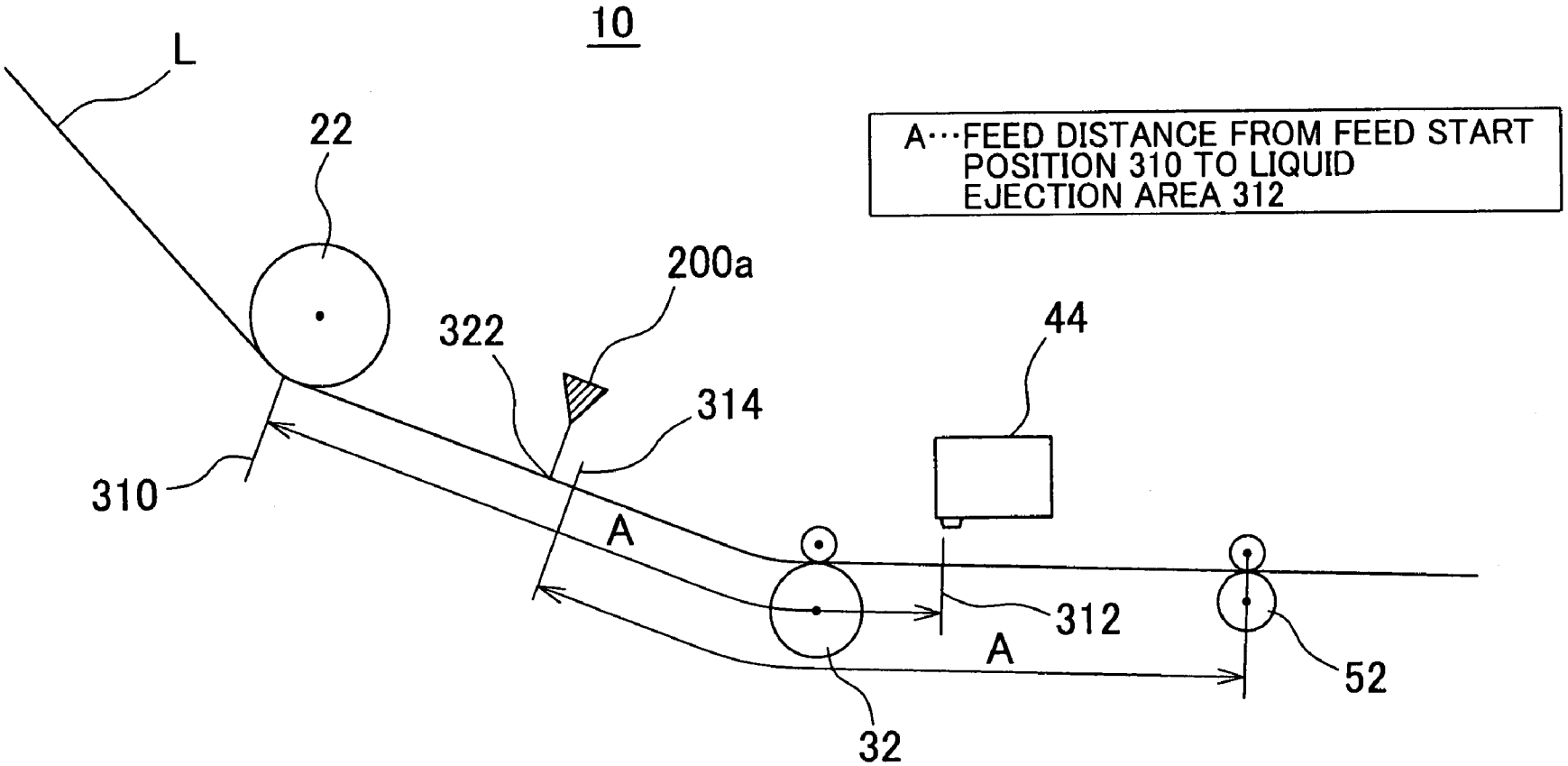
FIG. 8 shows a first example of controlling the transfer operation of the recording medium 11.

FIG. 8 shows a first example of controlling the transfer operation of the recording medium 11 in response to the position of the rear end of the recording medium 11. A path L is defined as the transfer path along which the recording medium 11 is discharged via the feed roller 22, the transfer unit 30, and the discharge unit 50. A distance A is defined as the distance between a feed start position 310 on the path L at which the feed roller 22 starts to transfer the recording medium 11 and a boundary 312 of the liquid ejection area formed by the recording head 44. The distance A is the transfer distance when the recording medium 11 is transferred to the liquid ejection area. Further, the feed start position 310 is the position of the recording medium 11 when the recording medium 11 contacts the feed roller 22 because the hopper 124 moves upwards.

If the position of the rear end of the recording medium 11 on which recoding has just been finished is situated downstream of a position 314 which is upstream of the discharge roller 52 as much as the distance A along the path L, when the feed operation starts for the recording medium 11 which will be recorded next, the recording medium 11 is discharged before the feed operation is finished.

Accordingly, the inkjet type recording apparatus 10 of this embodiment includes a detecting unit 200*a* for detecting the recording medium 11 at the position 322 which is upstream of the position 314, whereby when recording or printing is finished, it controls the timing for feeding the next recording medium 11 in response to whether the detecting unit 200*a* detects the recording medium 11 or not. Further, the detecting unit 200*a* is an example of a recording medium sensor of this invention and a first example of the installation position of the detecting unit 200 described in connection with FIG. 2.

Figure 9:
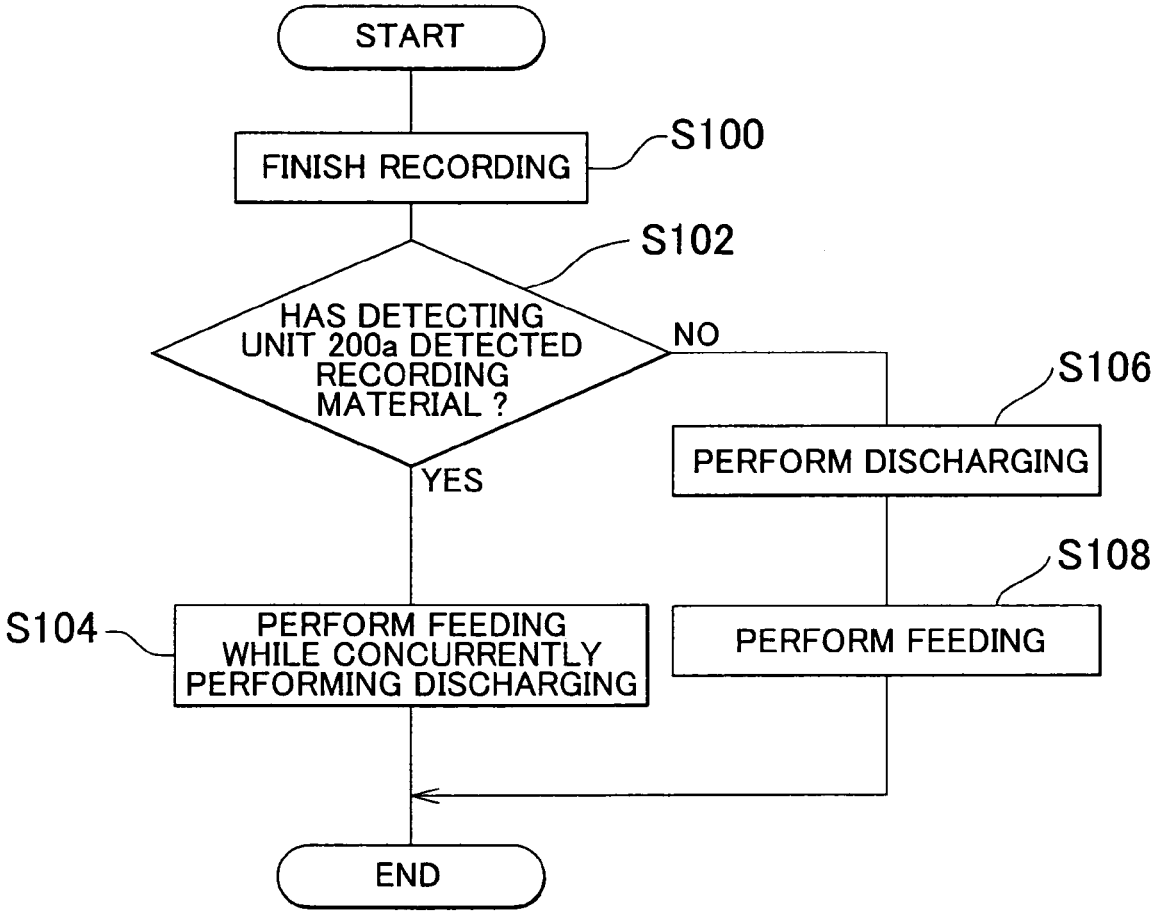
FIG. 9 is a first example of the operation of the inkjet type recording apparatus 10.

FIG. 9 is a flowchart showing an example of the control operation described in connection with FIG. 8. First, the control unit 80 detects whether recording or printing has been finished on the recording medium 11 or not (S100). Then, it checks whether the detecting unit 200*a* detects the recording medium 11 (S102). If it is considered in the step 102 that the detecting unit 200*a* has detected the recording medium 11 (S102: Yes), the control unit 80 controls the step motor 60 to rotate reversely so that the roller lock mechanism 400 stops preventing the rotation of the feed roller 22, and feeds the recording medium 11 which will be recorded next at high speed, e.g. 14[ips] to the liquid ejection area simultaneously with the discharge of the recording medium 11 on which recording has been finished (S104). Further, the discharge of the recording medium 11 is not finished when the step 104 is finished, but it is finished accompanying the transfer operation during the recording operation on the next recording medium 11 fed into the liquid ejection area.

Meanwhile, if it is considered in the step 102 that the detecting unit 200*a* has not detected the recording medium 11 yet (S102: No), the control unit 80 controls the step motor 60 to rotate forward so as to rotate the discharge roller 52 while maintaining the rotation prevention of the feed roller 22 by the roller lock mechanism 400, and discharges the recording medium 11 at the speed which guarantees the stackability, e.g. 10[ips] (S106). Then, it controls the step motor 60 to rotate reversely so that the rotation prevention of the feed roller 22 is stopped, and feeds the recording medium 11 which will be recorded next at high speed, e.g. 14[ips] by controlling the step motor 60 to rotate at higher speed than that of the discharge in the step 106 (S108). Then the flow is finished. According to the above operation, the inkjet type recording apparatus 10 can obtain the stackability as well as improving the throughput.

Figure 10:
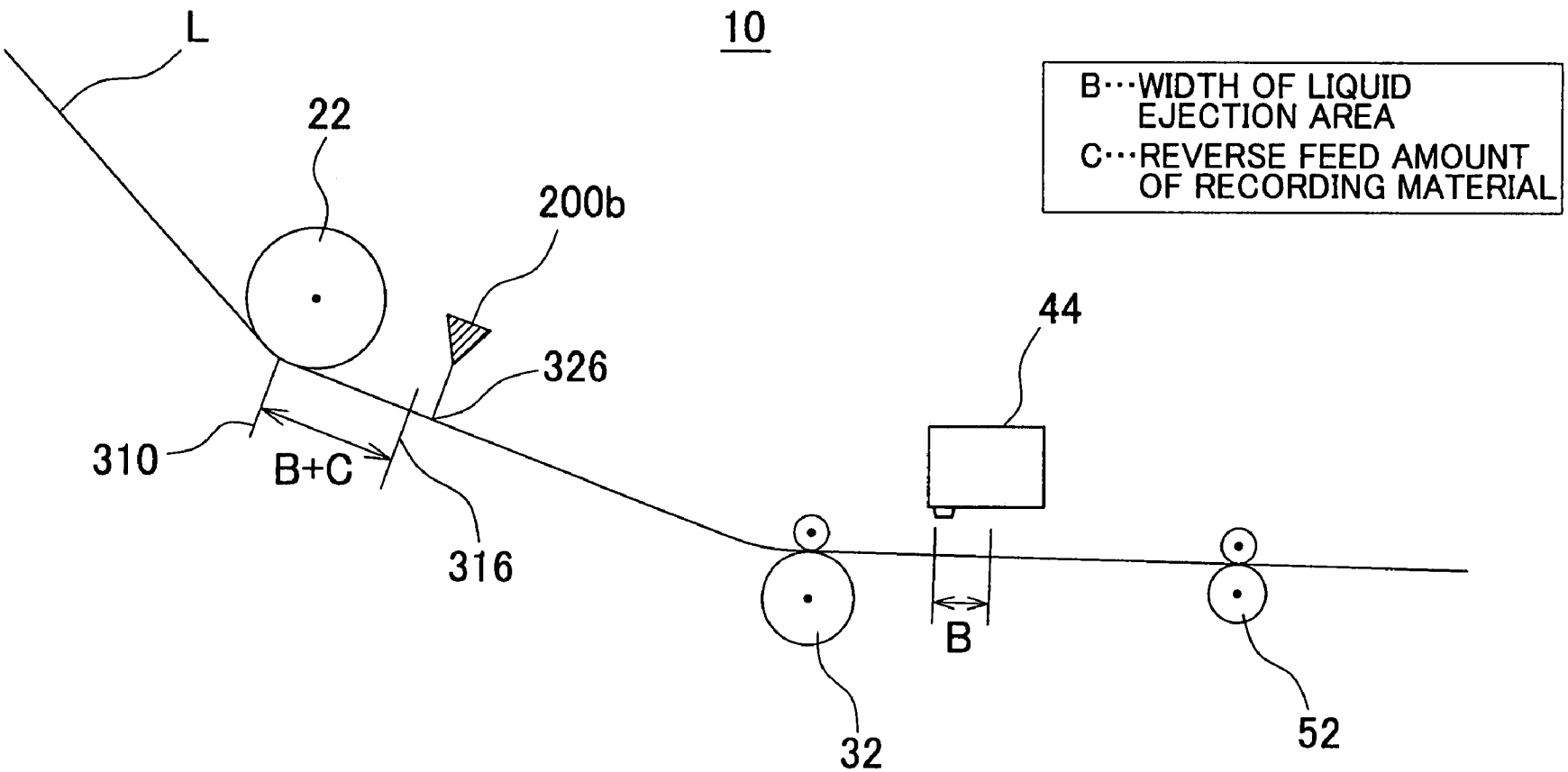
FIG. 10 shows a second example of controlling the transfer operation of the recording medium 11.

FIG. 10 shows a second example of controlling the transfer operation of the recording medium 11 in response to the position of the rear end of the recording medium 11. The inkjet type recording apparatus 10 of this embodiment includes a detecting unit 200*b* in replace of the detecting unit 200*a* in FIG. 9. Other configurations are the same as those in connection with FIG. 8, so they will be described. In this embodiment, an ejection area width B is defined as the width of the liquid ejection area in the transfer direction of the recording medium 11, and a transfer amount C as the distance by which the recording medium 11 is transferred since the step motor 60 rotates reversely when the rotation prevention of the feed roller 22 is stopped. The detecting unit 200*b* is situated at a position 326 further downstream of a position 316 which is downstream of the feed start position 310 of the recording medium 11, which will be recorded next, as much as the sum (B+C) of the ejection area width B and the transfer amount C.

When the inkjet type recording apparatus 10 of this embodiment finishes recording on the recording medium 11, it controls the timing for transferring the next recording medium 11 in response to whether the detecting unit 200*b* detects the recording medium 11 or not. Further, the detecting unit 200*b* is another example of the recording medium sensor of this invention, and a second example of the installation position of the detecting unit 200 described in connection with FIG. 2.

Figure 11:
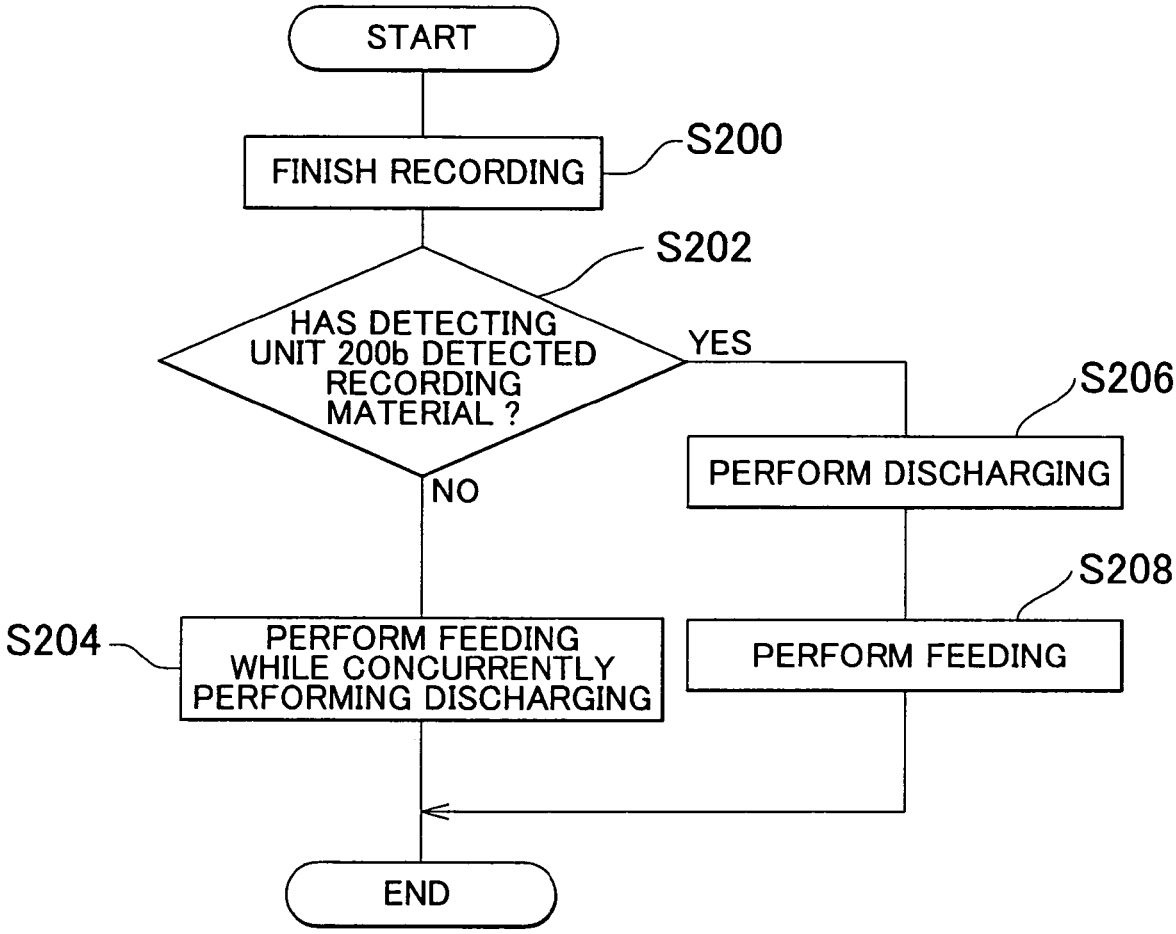
FIG. 11 is a second example of the operation of the inkjet type recording apparatus 10.

FIG. 11 is a flowchart showing an example of the control operation described in connection with FIG. 10. First, the control unit 80 detects whether recording or printing has been finished on the recording medium 11 or not (S200). Then, it checks whether the detecting unit 200*b* has detected the recording medium 11 or not (S202). If it is considered in the step 202 that the detecting unit 200*b* has not detected the recording medium 11 yet (S202: No), the control unit 80 controls the step motor 60 to rotate reversely so that the roller lock mechanism 400 stops preventing the rotation of the feed roller 22, and feeds the recording medium 11 which will be recorded next at high speed, e.g. 14[ips] simultaneously with the discharge of the recording medium 11 on which recording has been finished (S204).

Meanwhile, if it is considered in the step 202 that the detecting unit 200*b* has detected the recording medium 11, (S202: Yes), the control unit 80 controls the step motor 60 to rotate forward so as to rotate the discharge roller 52 while maintaining the rotation prevention of the feed roller 22 by the roller lock mechanism 400, and discharges the recording medium 11 at the speed which guarantees the stackability, e.g. 10[ips] (S206). Then, it controls the step motor 60 to rotate reversely so that the rotation prevention of the feed roller 22 is stopped, and feeds the recording medium 11 which will be recorded next at high speed, e.g. 14[ips] by controlling the step motor 60 to rotate at higher speed than that of the discharge in the step 206 (S208). Then the flow is finished.

According to the above operation, although the step motor 60 rotates reversely so as to start the feed of the next recording medium 11, the recording medium 11 on which recording has been finished is not transferred reversely until it is overlapped on the end of the next recording medium 11. Further, although the recording medium 11 on which recording has been finished due to the reverse rotation of the step motor 60 is transferred, the distance between the end of the next recording medium 11 and the rear end of the recording medium 11 on which recording has been finished is sure to be more than the width B of the ejection area. Accordingly, since the rear end of the recording medium 11 on which recording has been finished is positioned out of the liquid ejection area of the recording head 44 when recording is performed on the next recording medium 11, unnecessary liquid ejection is prevented.

Figure 12:
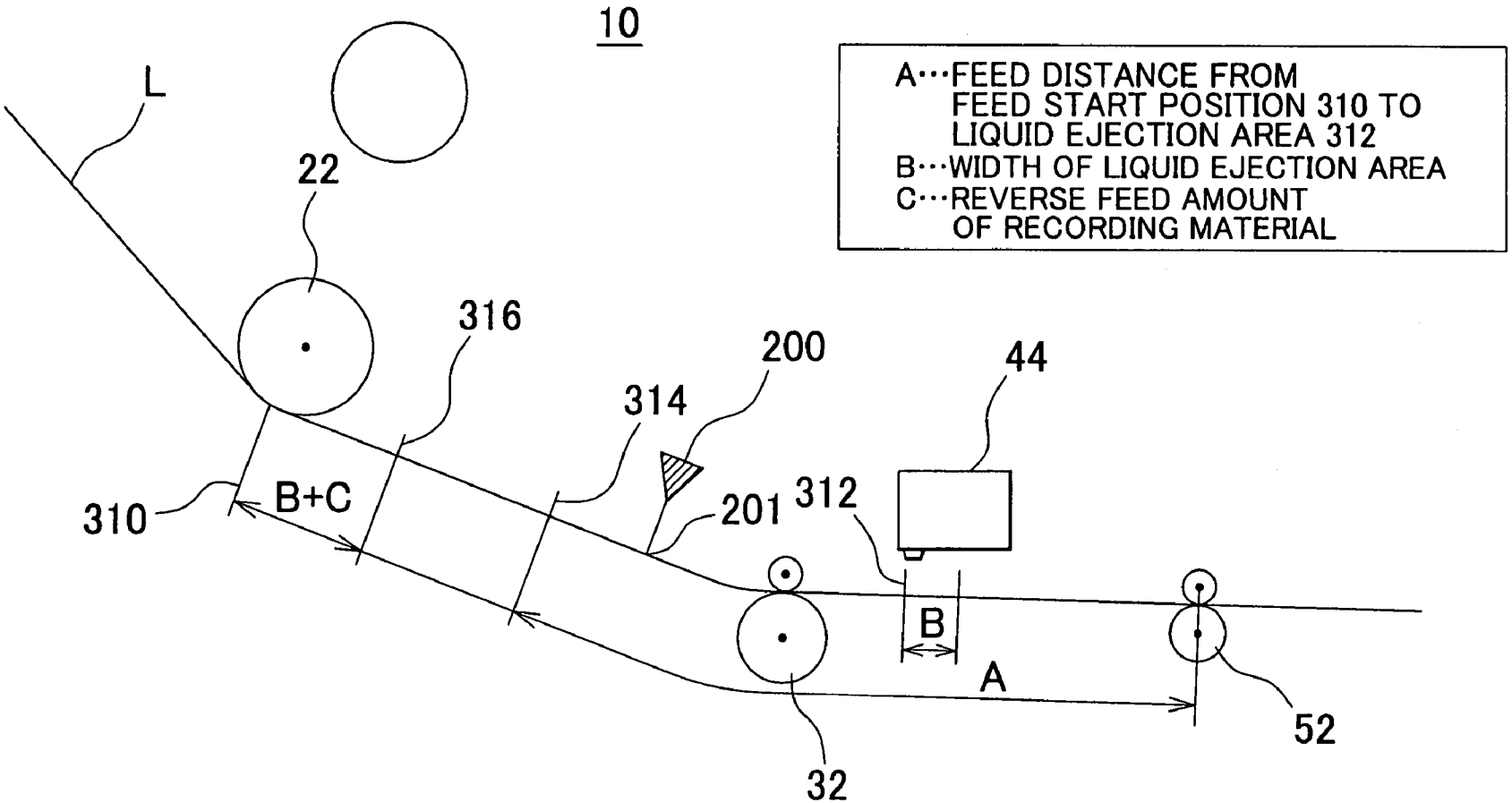
FIG. 12 shows a third example of controlling the transfer operation of the recording medium 11.

FIG. 12 shows a third example of controlling the transfer operation of the recording medium 11 in response to the position of the rear end of the recording medium 11. In this embodiment, the inkjet type recording apparatus 10 calculates the position of the rear end of the recording medium 11 based on the transfer distance of the recording medium 11, and controls the timing for feeding the next recording medium 11 based on the position of the rear end of the recording medium 11 on which recording has been finished. In this embodiment, the detecting unit 200 for recognizing the recording medium 11 is positioned upstream of the feed start position 310 in order to recognize the existence of the recording medium 11 upstream of a boundary position 312 of the liquid ejection area. The feed start position 310, the position 316, the position 314, and the boundary position 312 as well as the distance A, the ejection area width B, and the transfer amount C are the same as those of the first or second example, so they will not be described.

The control unit 80 in this embodiment calculates the position of the rear end of the recording medium 11 on which recording has been finished based on the transfer amount of the recording medium 11, and controls the timing for feeding the recording medium 11 based on whether the calculated position of the rear end is situated further downstream of the feed start position 310 than B+C and further upstream of the discharge roller 52 than the distance A or not. Accordingly, both the overlap and stain of the recording mediums 11 can be prevented, and with regard to the stackability the transfer throughput of the recording medium transfer apparatus can be improved.

Figure 13:
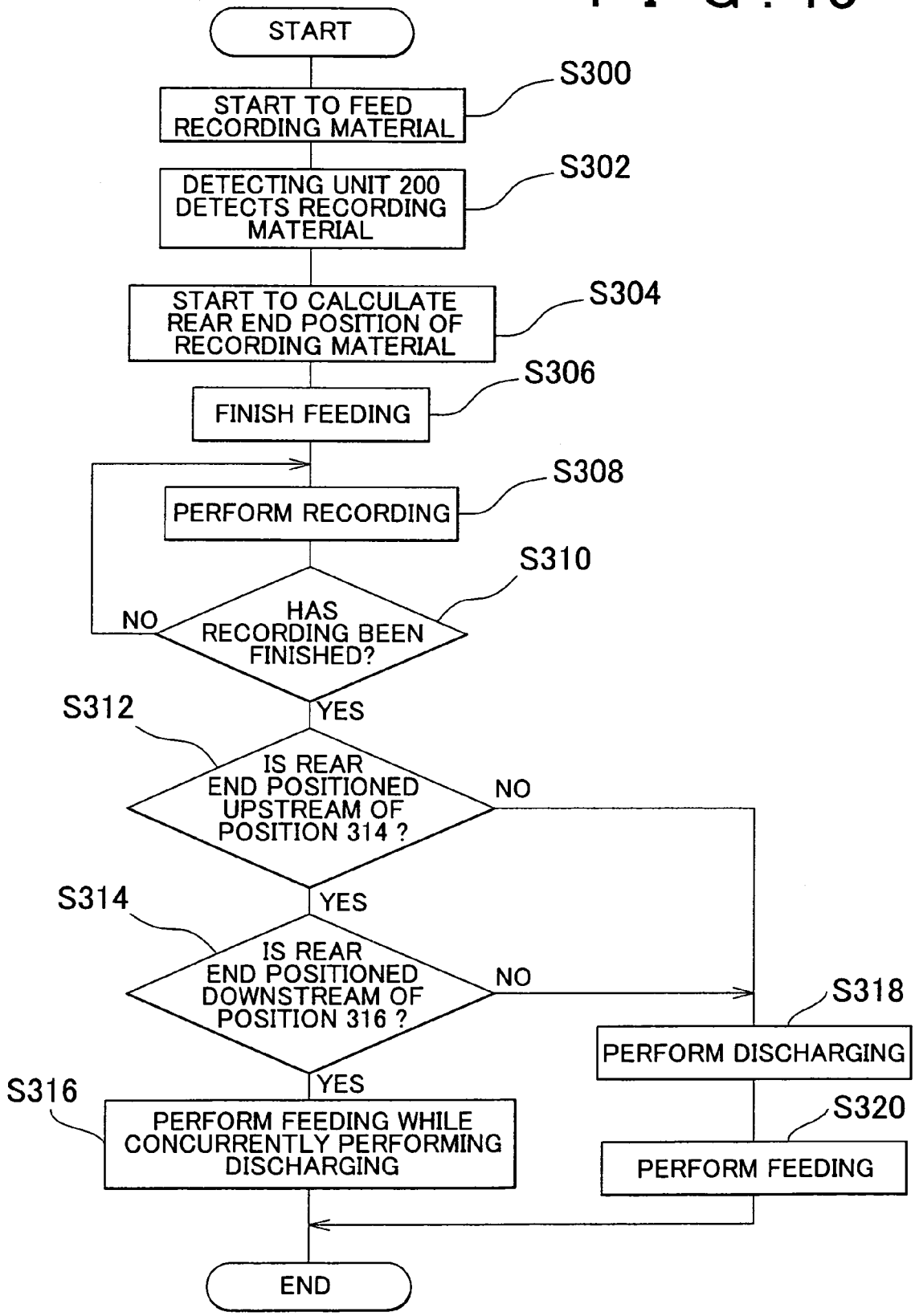
FIG. 13 is a third example of the operation of the inkjet type recording apparatus 10.

FIG. 13 is a flowchart showing an example of the control operation described in connection with FIG. 12. First, the control unit 80 starts to transfer the recording medium 11 (S300). Then, the control unit 80 detects the recording medium 11 (S302). Then, the control unit 80 calculates the end position of the recording medium 11 based on the rotation amount of the step motor 60 from when the detecting unit 200 detects the recording medium 11 and the position 201 at which the detecting unit 200 detects the recording medium 11, and starts to calculate the position of the rear end of the recording medium 11 based on the calculated end position and the length of the recording medium 11 in the transfer direction (S304).

Then, when the feed of the recording medium 11 is finished (S306), the control unit 80 performs recording on the recording medium 11 (S308). Next, the control unit 80 checks whether recording has been finished on the recording medium 11 or not (S310). If it is considered in the step 310 that recording has not been finished yet (S310: No), recording is performed back in the step 308. If it is considered in the step 310 that recording has been finished (S310: Yes), the control unit 80 checks whether the position of the rear end of the recording medium 11 on which recording has been finished is situated upstream of the position 314 or not (S312).

If it is considered in the step 312 that the position of the rear end is situated upstream of the position 314 (S312: Yes), then the control unit 80 checks whether the position of the rear end of the recording medium 11 on which recording has been finished is situated downstream of the position 316 (S314). If it is considered in the step 314 that the position of the rear end is situated downstream of the position 316 (S314: Yes), the control unit 80 controls the step motor 60 to rotate reversely so that the roller lock mechanism 400 stops preventing the rotation of the feed roller 22, and feeds the recording medium 11 which will be recorded next at the speed of 14[ips] simultaneously with the discharge of the recording medium 11 on which recording has been finished (S316).

Meanwhile, if it is considered in the step 312 that the position of the rear end is not situated upstream of the position 314 (S312: No) or it is considered in the step 314 that the position of the rear end is not situated downstream of the position 316 (S314: No), the control unit 80 controls the step motor 60 to rotate forward so as to rotate the discharge roller 52 while maintaining the rotation prevention of the feed roller 22 by the roller lock mechanism 400, and discharges the recording medium 11 at the speed which guarantees the stackability, e.g. 10[ips] (S318)

Then, it controls the step motor 60 to rotate reversely so as to stop preventing the rotation of the feed roller 22, and feeds the recording medium 11 which will be recorded next at the speed of 14[ips] by controlling the step motor 60 to rotate at higher speed than that during the discharge of the step 318 (S320). Then the flow is finished. According to the above operation, the inkjet type recording apparatus 10 can improve the recording throughput while obtaining the stackability and preventing both the overlap and stain of the recording mediums As obvious from the description above, according to the present invention, it is possible to improve the recording throughput by way of the inkjet type recording apparatus.

Although the present invention has been described by way of exemplary embodiments, it should be understood that those skilled in the art might make many changes and substitutions without departing from the spirit and the scope of the present invention which is defined only by the appended claims.

What is claimed is:

1. A recording medium transfer apparatus for feeding a recording medium, on which recording or printing is performed by ejecting liquid, to a liquid ejection area in which said liquid is ejected onto said recording medium, comprising:

a feed roller for feeding said recording medium towards said liquid ejection area;

a discharge roller for discharging said recording medium, on which recording or printing has been performed, out of said liquid ejection area;

a motor for driving said feed and discharge rollers;

a control unit which:

controls said motor to rotate at higher speed when said recording medium is fed to said liquid ejection area than that when said recording medium is discharged out of said liquid ejection area, and controls a next recording medium to be fed simultaneously with discharge of said recording medium, if a position of a rear end of said recording medium when recording or printing has been finished is situated upstream of a predetermined position, which is upstream of said discharge roller as much as a distance between a feed start position of said recording medium and said liquid ejection area, and which controls said next recording medium to start to be fed after discharge of said recording medium has been finished, if said position of said rear end of said recording medium when recording or printing has been finished is situated downstream of said predetermined position; and a recording medium sensor disposed at said predetermined position for detecting said recording medium, wherein said control unit controls said next recording medium to be fed simultaneously with discharge of said recording medium, if said recording medium sensor detects said recording medium when recording or printing has been finished, and controls said next recording medium to be fed after discharge of said recording medium has been finished, if said recording medium sensor does not detect said recording medium when recording or printing has been finished.

2. A recording medium transfer apparatus for feeding a recording medium, on which recording or printing is performed by ejecting liquid, to a liquid ejection area in which said liquid is ejected onto said recording medium, comprising:

a feed roller for feeding said recording medium towards said liquid ejection area;

a discharge roller for discharging said recording medium, on which recording or printing has been performed, out of said liquid ejection area;

a motor for driving said feed and discharge rollers;

a control unit which:

controls said motor to rotate at higher speed when said recording medium is fed to said liquid ejection area than that when said recording medium is discharged out of said liquid ejection area, and controls a next recording medium to be fed simultaneously with discharge of said recording medium, if a position of a rear end of said recording medium when recording or printing has been finished is situated upstream of a predetermined position, which is upstream of said discharge roller as much as a distance between a feed start position of said recording medium and said liquid ejection area, and which controls said next recording medium to start to be fed after discharge of said recording medium has been finished, if said position of said rear end of said recording medium when recording or printing has been finished is situated downstream of said predetermined position; and a roller lock mechanism driven by said motor for preventing said feed roller from being rotated by said motor or stopping rotation prevention of said feed roller by reverse rotation of said motor, wherein when said motor rotates forward, said feed and discharge rollers are rotated in such direction that said recording medium is transferred forward, and said control unit uses, as said predetermined position, a position situated further downstream of said feed start position than a sum of a reverse transfer amount by which said recording medium is transferred reversely due to said reverse rotation of said motor while said rotation prevention is being stopped and width of said liquid ejection area in a transfer direction of said recording medium.

3. A recording medium transfer apparatus, as claimed in claim 2, wherein:

said control unit controls the next recording medium, which will be fed next, to be fed simultaneously with the discharge of said recording medium, when a distance, between the rear end of said recording medium when recording or printing has finished, and said feed start position, is larger than:

the sum of the reverse transfer amount by which said recording medium is transferred reversely due to said reverse rotation of said motor while said rotation prevention is being stopped, and the width of said liquid ejection area in the transfer direction of said recording medium.

4. A recording medium transfer apparatus, as claimed in claim 3, further comprising:

a recording medium sensor disposed further downstream of said feed start position than the sum of said reverse transfer amount and said width of said liquid ejection area in said transfer direction of said recording medium for detecting said recording medium; wherein when said recording medium sensor does not detect said recording medium when recording or printing has finished, said control unit controls said next recording medium to be fed simultaneously with the discharge of said recording medium; and when said recording medium sensor detects said recording medium when recording or printing has finished, said control unit controls said next recording medium to start to be fed after discharge of said recording medium.

* * * * *